US006334039B1

(12) United States Patent
Yoshinaga et al.

(10) Patent No.: US 6,334,039 B1
(45) Date of Patent: Dec. 25, 2001

(54) METHOD AND APPARATUS FOR IMAGE FORMING APPARATUS CAPABLE OF ACCURATELY DETECTING TONER IMAGE PATTERNS

(75) Inventors: Hiroshi Yoshinaga, Chiba; Masumi Sato, Kanagawa; Kazuhiko Yuuki, Kanagawa; Yoshinori Ozawa, Kanagawa; Atsushi Takehara, Kanagawa, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/612,283

(22) Filed: Jul. 7, 2000

(30) Foreign Application Priority Data

Jul. 14, 1999 (JP) ..... 11-199922

(51) Int. Cl.[7] ..... G03G 15/16
(52) U.S. Cl. ..... 399/298; 399/299; 399/306
(58) Field of Search ..... 399/298, 299, 399/300, 223, 231

(56) References Cited

U.S. PATENT DOCUMENTS 5,659,843 8/1997 Takano et al. .
5,719,684 2/1998 Ohkaji et al. .

FOREIGN PATENT DOCUMENTS 6-95474 4/1994 (JP) .
7-311532-A * 11/1995 (JP) .
8-328395-A * 12/1996 (JP) .
10-282783 10/1998 (JP) .
11-65315 3/1999 (JP) .

* cited by examiner

*Primary Examiner*—Quana M. Grainger
(74) *Attorney, Agent, or Firm*—Oblon, Spivak, McClelland, Maier & Neustadt, P.C.

(57) ABSTRACT

An image forming apparatus includes a belt member to convey a sheet-formed medium, a belt supporting device to support the belt member, and a plurality of recording units including rotating image bearing members arranged in a conveying direction of the sheet-formed medium by the belt. The image forming apparatus performs processes of (1) forming a latent image on a surface of each image bearing member, (2) developing each latent image into a toner image with toner, and (3) then transferring each toner image onto the sheet-formed medium carried on the belt. A detection device detects arbitrary toner image patterns formed at the plurality of recording units and then directly transferred onto the belt, for obtaining information about density and placements of images without the toner patterns being deteriorated by contacting following downstream recording units.

26 Claims, 6 Drawing Sheets

METHOD AND APPARATUS FOR IMAGE FORMING APPARATUS CAPABLE OF ACCURATELY DETECTING TONER IMAGE PATTERNS

BACKGROUND OF THE INVENTION

1. Field of the Invention

The present invention relates to an image forming apparatus such as a copying machine, a facsimile, a printer, etc., and more particularly to an image forming apparatus having a plurality of recording units and a belt to convey a sheet-formed medium.

2. Discussion of the Background

A technology for a full color image forming method to form a full color image by transferring plural color images one after another using a plurality of electrostatic recording units in an electrophotographic color image forming apparatus is described in Japanese Patent Laid-Open Publication No. 10-333398.

A technology for separating a transfer belt from photoconductive elements used for color image formation in a black and white image forming mode to avoid unnecessary depletion of the photoconductive elements is described in Japanese Patent Laid-Open Publication No. 11-95619. A technology for preventing deformation of a transfer belt is described in Japanese Patent Laid-Open Publication No. 11-95516.

The above-mentioned technologies make it possible to prevent deformation of a transfer belt and unnecessary depletion of the photoconductive elements used for color image formation caused by rotating the transfer belt in a black and white image forming mode, in a warm-up state, or in a stand-by position. However, the transfer belt is always in contact with the photoconductive elements used for color image formation in a full color image forming mode. In order to measure a toner density of a developing unit or to detect displacement of toner images among the photoconductive elements, sensor patterns of toner images are formed on the transfer belt by being directly transferred from the photoconductive elements. When the sensor patterns are detected by a sensor disposed at a downstream side of the transfer belt, the sensor pattern, for example formed on the photoconductive element located at the most upstream side, may not be accurately detected due to, for example, a decrease in an amount of adhered toner of the sensor pattern and a mixture of background fouling toner on photoconductive elements with the sensor pattern caused by a reverse transfer of the sensor pattern to other photoconductive elements, and scattered toner in a nip formed between the transfer belt and the photoconductive element because the sensor pattern contacts three other photoconductive elements before the sensor pattern is detected.

SUMMARY OF THE INVENTION

The present invention has been made in view of the above-discussed and other problems and addresses the above-discussed and other problems.

The present invention advantageously provides a novel image forming apparatus forming a full color image with good color balance without displacements of images by detecting information about density and placements of toner images transferred onto a belt.

According to an embodiment of the present invention, an image forming apparatus includes a belt member to convey a sheet-formed medium, a belt supporting device to support the belt member, and a plurality of recording units including rotating image bearing members. The plurality of recording units are arranged in a conveying direction of the sheet-formed medium by the belt to perform the processes of (1) forming a latent image on a surface of each image bearing member, (2) developing each latent image into a toner image with toner, and (3) then transferring each toner image onto the sheet-formed medium carried on the belt. The image forming apparatus also includes a detection device to detect arbitrary toner images formed at the plurality of recording units and then directly transferred onto the belt, and a contact and separation device which enables the belt to contact and separate from the image bearing members. The contact and separation device is configured to be driven so as to separate the belt from the image bearing members before each toner image contacts the respective following recording unit.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
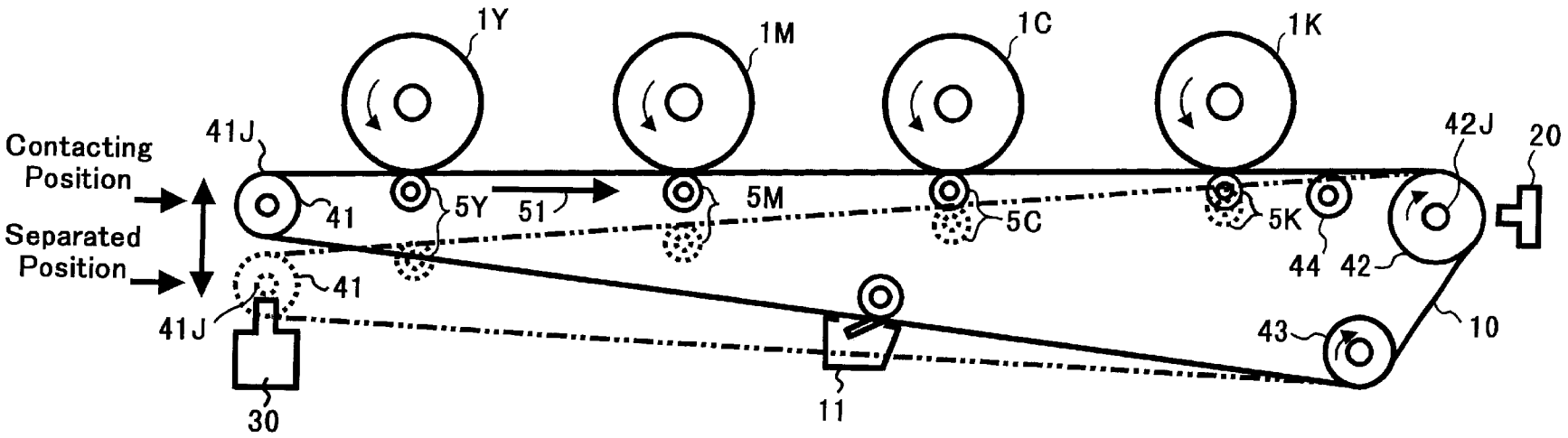
FIG. 1 is a schematic drawing illustrating an image forming section and a belt device of a tandem color printer.

Referring now to the drawings, wherein like reference numerals designate identical or corresponding parts throughout the several views, FIG. 1 is a schematic drawing illustrating an image forming section and a belt device of a tandem multicolor printer as an example of an image forming apparatus. A belt 10, referred to as a transfer belt, conveys a sheet-formed medium such as a recording sheet, a sheet, a transfer sheet, and so forth at a constant speed. The belt 10 is supported by rollers 41, 42, 43 and a supplemental roller 44. One roller among the rollers 41, 42, and 43 is configured to rotate, as a driving roller, at a constant speed in the clockwise direction. The rollers 41, 42, and 43 and the supplemental roller 44 constitute a belt support device together with an arm 50 (see FIG. 4) and a frame 45 (see FIG. 5).

On the belt 10 supported between the roller 41 and the supplemental roller 44, four recording units are disposed at the same spacing in a transfer sheet conveying direction as indicated by arrow 51 in FIG. 1.

FIG. 1 illustrates only drum-shaped photoconductive elements 1Y, 1M, 1C, and 1K as image bearing members in the recording units.

Each of photoconductive elements 1Y, 1M, 1C, and 1K is configured to rotate in a direction indicated by an arrow at the same circumferential speed as that of the belt 10. A latent image is respectively formed on a surface of each photoconductive element 1Y, 1M, 1C, and 1K and is developed into a toner image with color toner as described below. Each toner image is transferred onto a transfer sheet conveyed on the belt 10. Then, the sheet is discharged to an exit tray after the transferred image onto the transfer sheet has been fixed at a fixing unit. Each recording unit performs a process of a latent image formation, a development of the latent image, a transfer of a toner image, and so forth.

Figure 6:
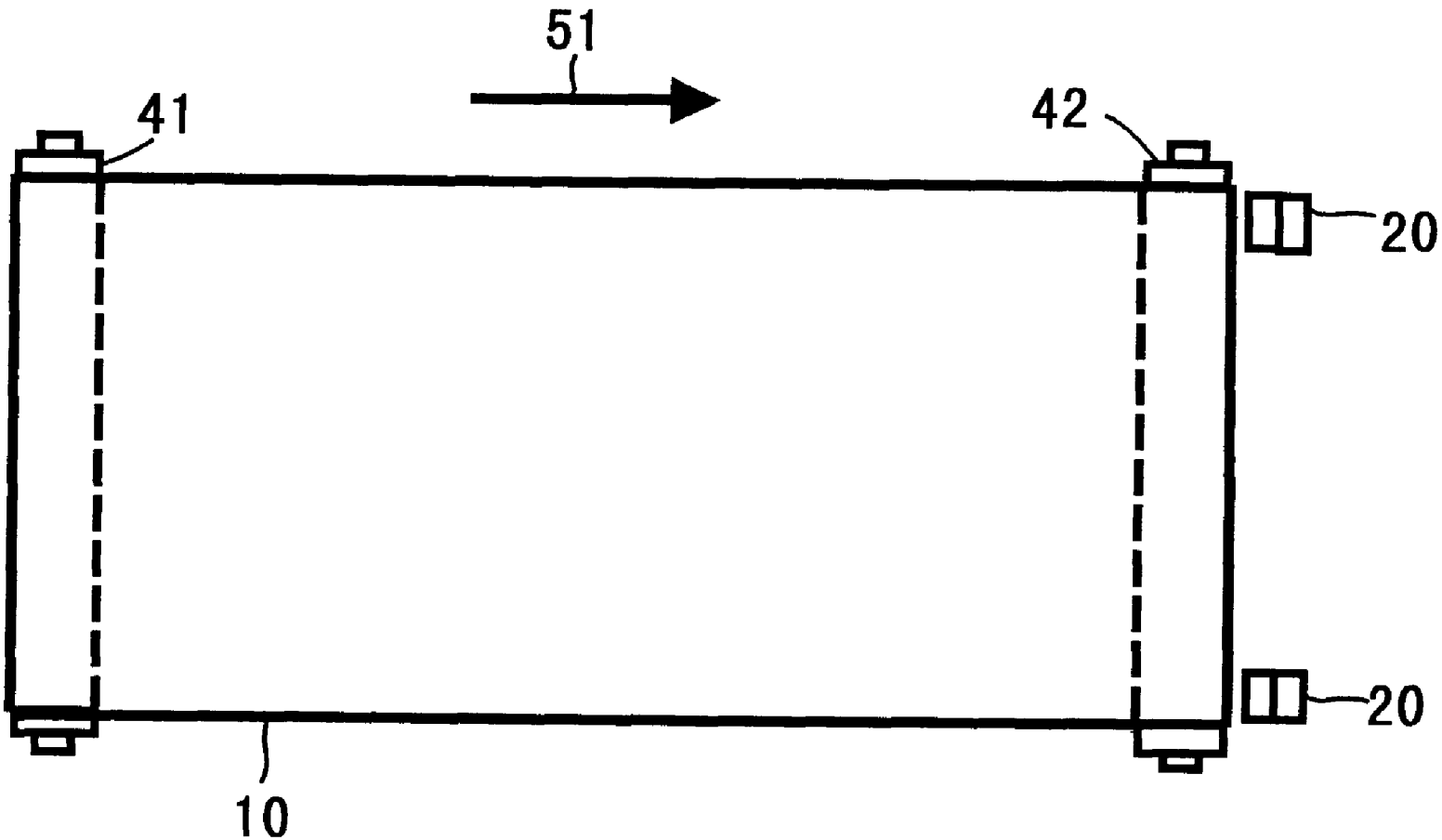
FIG. 6 is a plan view of a belt.

In addition, and as also shown in FIG. 6, two sensors 20 are located in an axial direction of the roller 42 opposing the belt 10 suspended on the roller 42 in order to detect information about a density and a placement of a toner image.

Figure 2:
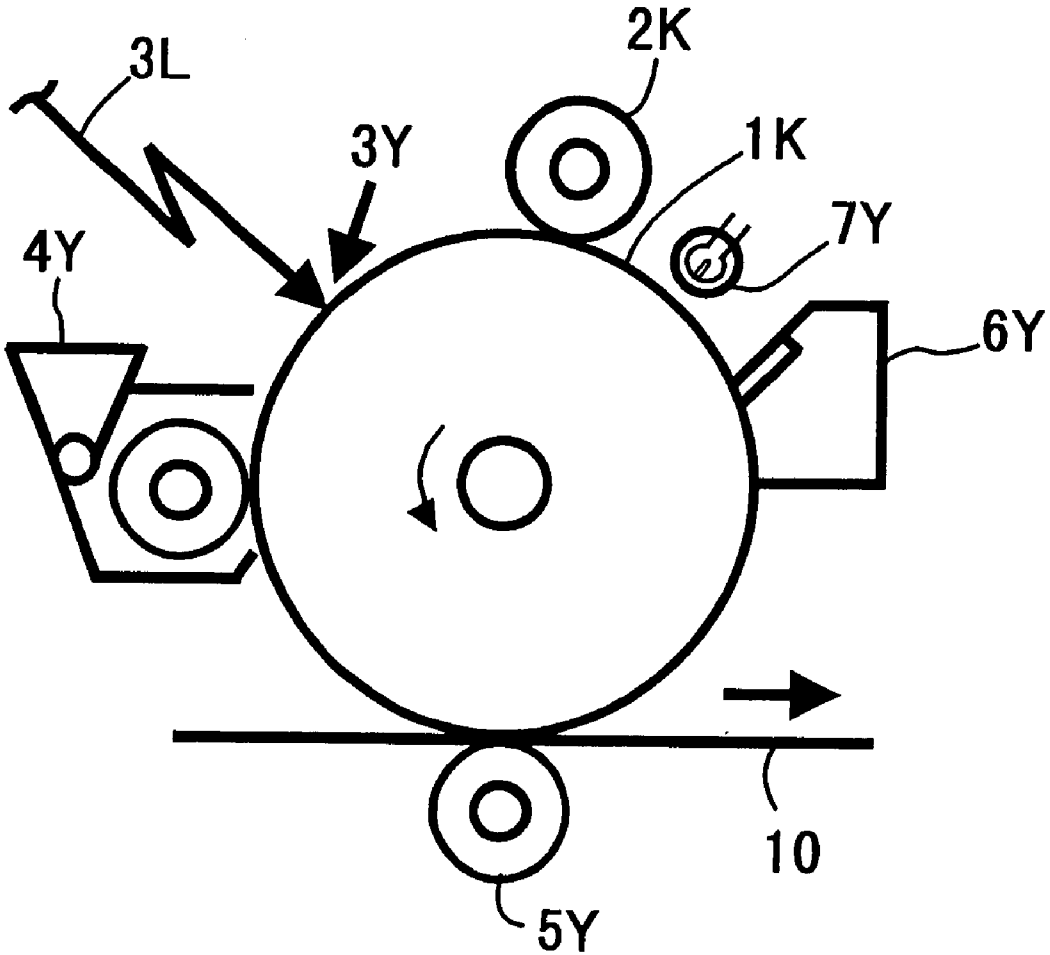
FIG. 2 explains a main portion of a recording unit for yellow.

FIG. 2 illustrates a recording unit. The color printer includes four recording units as illustrated in FIG. 1. Because the structure of the recording units is identical to each other, an explanation will be made based on the recording unit for yellow as an example of each recording unit. Image data sent from a personal computer etc. is processed at a printer controller (not shown) and is converted into image data corresponding to reproduced colors of yellow (Y), magenta (M), cyan (C), and black (K). Hereinafter, each reproduced color is described with the letter Y, M, C, and K, and these letters Y, M, C, and K will be added to reference numerals of parts relating to the reproduced colors. The image data is converted into a signal for driving a laser diode scanning each line in synchronization with a supply of a sheet-formed medium.

As illustrated in FIG. 2, the recording unit for yellow includes a photoconductive element 1Y as a main member as well as other members, along with the photoconductive element 1Y in the rotating direction indicated by an arrow, such as a charging unit 2Y having a charging roller, an exposure unit 3Y receiving a scanning beam light 3L, a developing unit 4Y which stores developer including yellow toner while having a developing function, a transfer unit 5Y including a transfer roller press-contacting the photoconductive element 1Y through the belt 10, a cleaning unit 6Y removing residual toner remaining on the photoconductive element 1Y, a discharging lamp 7Y removing residual charge on the photoconductive element 1Y, etc. A light emitted from an light-emitting diode (LED) may be used instead of the scanning beam light 3L.

In the image forming operation, the photoconductive element 1Y charged at a predetermined potential by the charging unit 2Y is exposed according to the above-described image data at exposure unit 3Y to form an electrostatic latent image thereon. Toner selectively adheres to the electrostatic latent image at the developing unit 4Y and thereby a toner image is formed. The toner image is then transferred onto a transfer sheet conveyed by the transfer belt 10 at the transfer unit 5Y.

Residual toner remaining on the photoconductive element 1Y in a transfer operation is removed at the cleaning unit 6Y and residual charge is discharged by the discharging lamp 7Y to prepare the photoconductive element 1Y for a next image forming operation.

Toner images formed by the same process as described above in each recording unit are transferred onto the transfer sheet, electrostatically conveyed by the belt 10, in sequence at the transfer unit in each of the recording units located with the same spacing in-between.

In this operation, the image of each color is formed at corresponding recording units with a time lag among the recording units in order of their locations, i.e., from an upstream side to a downstream side so that each color toner image is transferred onto the transfer sheet one after and so that each color toner image is superimposed on each other. The transfer sheet carrying the multi-layered toner image is fixed at a fixing unit (not shown) and then is discharged by a discharging unit (not shown) to the outside of the image forming apparatus. The belt 10, after the transfer operation, is cleaned by a cleaning unit 11 where toner and paper lint adhered to the belt 10 are removed to prepare the belt 10 for a next sheet conveying operation.

The sensor 20 can be formed of a reflective photosensor having a light-emitting device such as a light-emitting diode (LED) and a light-receiving device such as a photodiode. However, when the belt 10 is transparent, a transmission photosensor may be used. According to the embodiment of the present invention, the sensor 20 includes a light-emitting device and a light-receiving device. The light emitted from the light-emitting device is irradiated on the belt 10, and the reflected light is received by the light-receiving device to be converted into an electric signal, and is then transmitted to a controlling device (not shown). The electric signal is processed by the controlling device to be used as information for controlling a toner density at the developing unit in each of the recording units and for correcting a placement of an image to avoid displacement of images written by each of the recording units.

Figure 4:
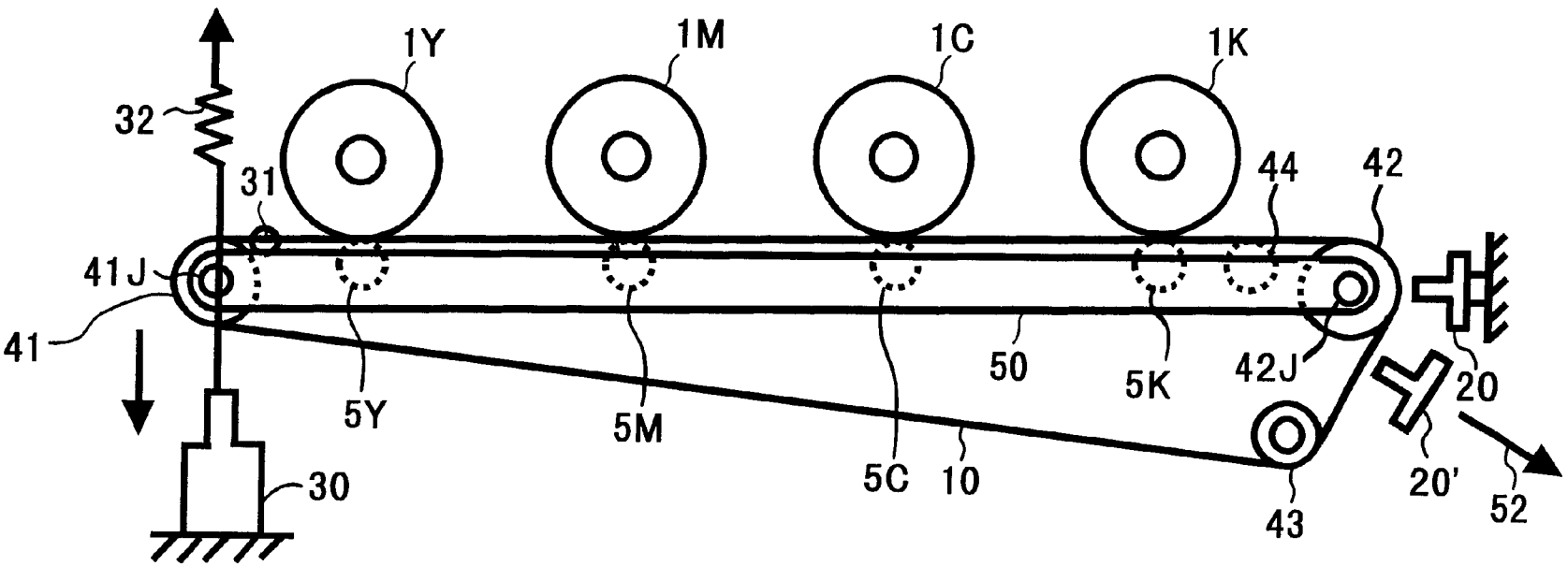
FIG. 4 is a front view of a belt support device according to an embodiment of the present invention.

The belt 10 is configured to contact and separate from the photoconductive elements 1Y, 1M, 1C, and 1K. FIG. 4 illustrates an example of a construction in which the belt 10 contacts or separates from the photoconductive elements. In the configuration, a shaft 42J of the roller 42 and a shaft 41J of the roller 41 are supported by the arm 50. When the belt 10 is separated from the photoconductive elements, the shaft 41J is pulled by a solenoid 30 as a separation device fulcruming the shaft 42J. For the belt 10 to contact the photoconductive elements 1Y, 1M, 1C, 1K, the solenoid 30 is turned off so that the arm 50 is moved back by a force of a spring 32 until it abuts against a stopper 31. Because the transfer unit 5Y as well as other transfer units 5M, 5C, and 5K are supported by the arm 50, the transfer units 5Y, 5M, 5C, and 5K are separated from the respective photoconductive elements 1Y, 1M, 1C, and 1K in accordance with the pivotal movement of the arm 50.

When the solenoid 30 is turned off, the arm 50 is placed at a contacting position as illustrated by a solid line in FIGS. 1 and 4 such that the arm 50 abuts against the stopper 31 with an elasticity of the spring 32 and each of the transfer units 5Y, 5M, 5C, and 5K contacts each of the photoconductive elements 1Y, 1M, 1C, and 1K respectively. When the solenoid 30 is turned on, the arm 50 is placed at a separated position as illustrated by a two-dotted and dashed line in FIG. 1 such that each of the transfer units 5Y, 5M, 5C, and 5K is separated from each of the photoconductive elements 1Y, 1M, 1C, and 1K.

In an image forming apparatus that forms a color image superimposing two or more toner images, and especially one that forms a full color image superimposing each toner image of Y, M, C, and K on each other, it is necessary to accurately control an amount of adhered toner of each color comparing to each predetermined value. This is because when a balance of the amount of adhered toner among colors of Y, M, C, and K is lost even by a single color, the image formed lacks a color balance, and a color difference compared to a predetermined chromaticity arises.

As a method for controlling the amount of adhered toner described above, a method which forms a predetermined density pattern on a photoconductive element and which measures a reflected density of the density pattern with an optical sensor is commonly known. However, when the above-described commonly known measuring method is applied to an image forming apparatus such as in the example of the present invention that forms a full color image superimposing each toner image formed by a plurality of the photoconductive elements 1Y, 1M, 1C, and 1K on each other, the number of sensors required corresponds to the number of photoconductive elements, i.e., four sensors would be required in the example of FIGS. 1 and 4, which results in an increase in costs and which may cause a variation in an amount of adhered toner due to variations in sensitivities of the different sensors.

According to the example of the present invention, a density pattern formed on each of the photoconductive elements 1Y, 1M, 1C, and 1K is transferred directly onto the belt 10 and then a reflected density of the density pattern transferred on the belt 10 is measured. In this manner, the density pattern can be detected only by a single pair of the sensors 20 without having one sensor per one photoconductive element.

When the reflected density of a density pattern is measured on the belt 10, the reflected density can be measured with an accuracy equivalent to that measured on the photoconductive element if the toner on the photoconductive element is transferred onto the belt 10 at a fixed ratio. Four transfer nips are respectively formed at transfer units 5Y and 5M and 5C and 5K.

However, a problem may arise if the density pattern formed on the photoconductive element 1Y located at the most upstream side and transferred onto the belt 10 contacts the transfer units 5M, 5C, and 5K before it reaches the sensors 20. Under that situation, the toner image of the density pattern, transferred from the photoconductive element 1Y onto the belt 10, may not accurately be measured because the amount of the adhered toner may decrease or the toner image of the density pattern may be mixed with background fouling toner on the photoconductive elements 1M, 1C, and 1K due to a reverse transfer of the density pattern to the photoconductive elements 1M, 1C, and 1K.

According to the example of the present invention, the arm 50 is configured to be moved to the separated position by the solenoid 30 so as to separate the belt 10 from the photoconductive elements 1Y, 1M, 1C, and 1K after the density pattern formed in each of the recording units have been transferred onto the belt 10 at each of the transfer units, but before the photoconductive element of the downstream recording unit contacts the density pattern transferred onto the belt, i.e. before the belt 10 is moved a distance so that the formed density patterns reach a next downstream transfer unit. That is, because the density pattern is formed on each of photoconductive elements 1Y, 1M, 1C, and 1K at the same time, the solenoid 30 is activated to move the arm 50 to the separated position so as to separate the belt 10 from the photoconductive elements 1Y, 1M, 1C, and 1K before the density pattern of each color transferred from the photoconductive elements 1Y, 1M, 1C, and 1K onto the belt 10 reaches the photoconductive element of the next downstream recording unit.

Accordingly, the density of the density pattern formed at each of the recording units Y, M, and C having the respective photoconductive elements 1Y, 1M, and 1C and then transferred onto the belt 10 can be accurately measured by the sensors 20 without decreasing the amount of the adhered toner and with avoiding mixture of the background fouling toner on the photoconductive elements 1M, 1C, and 1K caused by the reverse transfer of the density pattern to the photoconductive elements 1M, 1C, and 1K.

Figure 3:
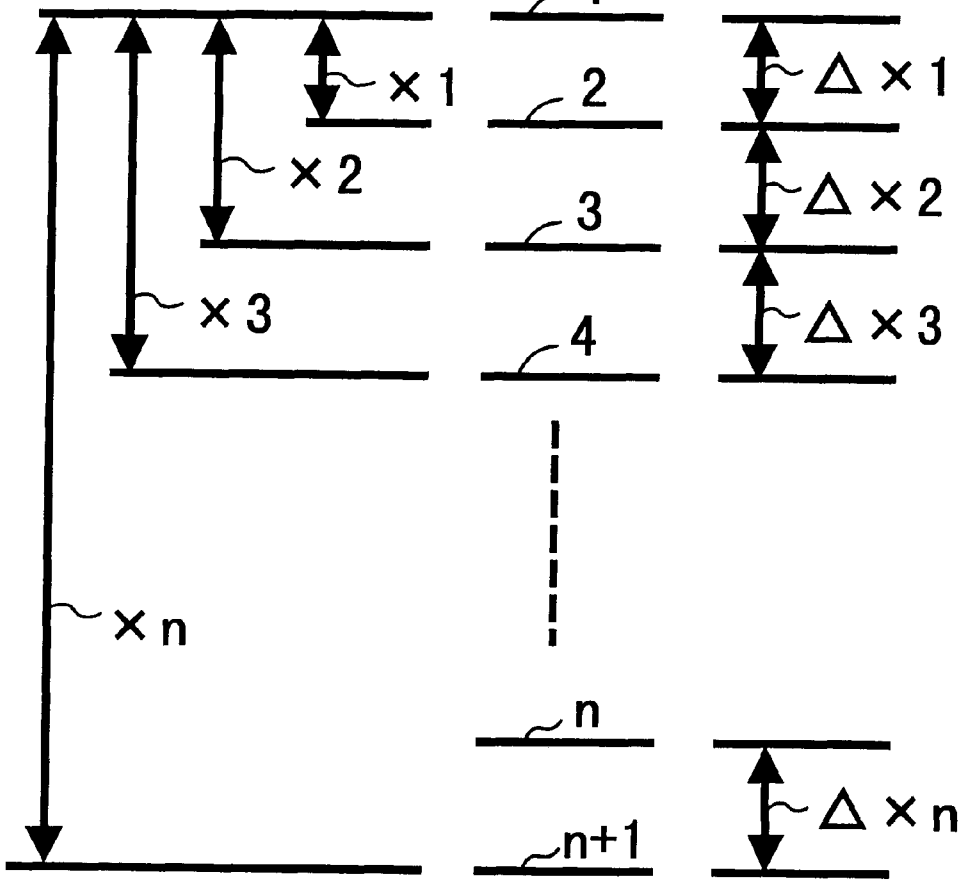
FIG. 3 illustrates a toner image pattern for detecting a displacement of an image.

A pattern formed for measuring a density is dependent on a characteristic of an apparatus, and therefore the pattern may be formed by a combination of a pattern of dots written or by changing a developing potential or a background potential through changing an applied voltage for a charging or a developing when the pattern is exposed by the scanning beam light 3L or an LED. In a tandem image forming apparatus, displacements of colors may be caused when an image formed at each of the recording units is not accurately superimposed on each other. Therefore, a method for correcting color displacements has been proposed in which such a pattern as illustrated in FIG. 3 is formed on the belt 10 and a placement of the pattern is detected by the sensors 20, and then a time to start writing an image at each recording unit is adjusted to correct the color displacements.

In this method, each space $\Delta X1, \Delta X2, \ldots \Delta Xn$ is detected that corresponds to a space between adjoining displacement detection marks 1~n, n+1 that constitute a displacement detection pattern and accumulated values X1, X2 . . . Xn are obtained. These accumulated values are obtained by the following calculations: $X1=\Delta X1$, $X2=\Delta X1+\Delta X2$, . . . $Xn=\Delta X1+\Delta X2+\ldots \Delta Xn$. Then a mean value $\Delta Xa$ is calculated by $\Delta Xa=Xn/n$. A displacement of $\delta dX1, \delta dX2, \ldots \delta Xn$ in each detection space $\Delta X1 \sim \Delta Xn$ under a constant belt speed is calculated as: $\delta X1=\Delta X1-\Delta xa$, $\delta X2=\Delta X2-\Delta xa, \ldots \delta Xn=\Delta Xn-\delta bXa$. When a linewidth of the marks 1~n varies due to an image fouling or the marks have a partial omission of an image caused by a reverse transfer of the marks to photoconductive elements, the detected space between adjoining marks $\delta X1, \Delta X2 \ldots \delta Xn$ and the accumulated values X1, X2 . . . Xn have an error, and therefore an accurate amount of displacement may not be detected.

Therefore, in an operation in the present invention after a density pattern formed in each of the recording units has been transferred onto the belt 10 at the transfer units 5Y, 5M, 5C, and 5K in each of the recording units, the solenoid 30 is activated to move the roller 41 to a separated position so that the belt 10 is separated from the photoconductive elements 1Y, 1M, 1C, and 1K before each of the transferred density pattern contacts photoconductive elements of the next downstream recording units of each recording unit. Thereby, the positions of the marks can be accurately measured without having an affect from image fouling or partial omission of the image caused by the reverse transfer of the marks to photoconductive elements.

In the apparatus having the belt 10, a difference does not occur in a relative position of the sensors 20 to the belt 10 when the arm 50 is pivoted by the operation of solenoid 30 in a case that the sensors 20 are disposed opposing the roller 42 at a side of a fulcrum of the pivot as illustrated in FIGS. 1 and 4.

Contrarily, as illustrated by a two-dotted and dashed line in FIG. 4, when the sensors 20' are provided to a fixed member at a position away from the roller 42 at the side of the fulcrum, the relative distance of the sensors 20' to the belt 10 varies according to the pivot of the arm 50, and thereby a measurement error may occur in the detection of the density pattern and the displacement pattern. As illustrated in FIG. 4, when the sensors 20' are provided to a fixed member at a position other than that opposite to the roller 42, the measurement can be performed accurately when the sensors 20' are configured to move their position by a predetermined distance, for example in the direction indicated by an arrow 52, in synchronization with the movement of the belt 10, when the solenoid 30 is driven considering a start-up time of the belt 10 and the sensors 20' so that the relative position of the sensors 20' to the belt 10 does not vary.

Especially, since it is known that a measurement accuracy of a reflective sensor greatly depends on a relative position to a pattern to be measured. Therefore, when a timing of the sensor to move close to and separate from the pattern is controlled precisely, the measurement can be carried out accurately.

Figure 5:
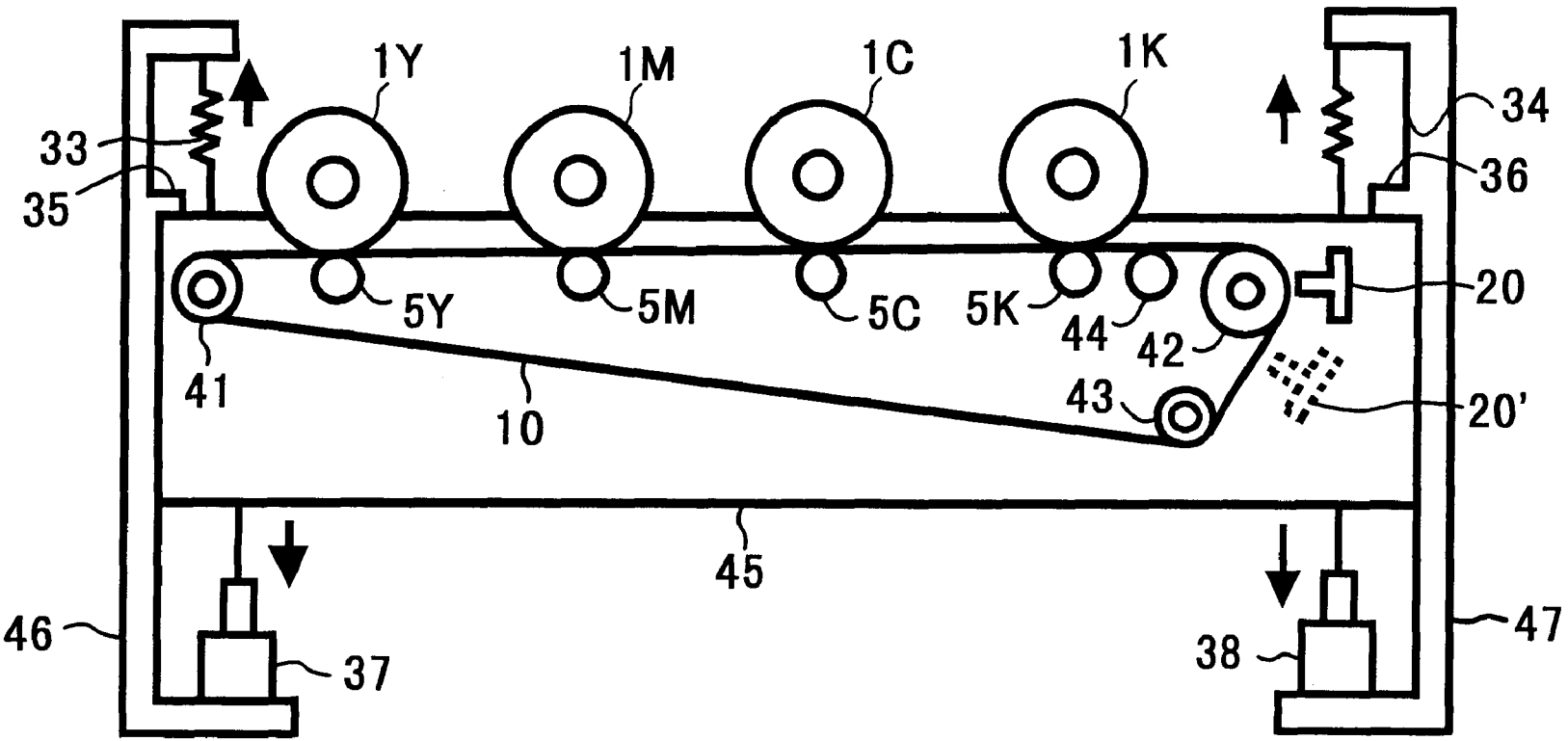
FIG. 5 is a front view of a belt support device according to another embodiment of the present invention.

In an another example, the rollers 41, 42, 43, and 44 for supporting the belt 10 are provided to the frame 45 as illustrated in FIG. 5. The frame 45 is configured to move along guides 46 and 47 in a direction that the frame 45 contacts and separates from the photoconductive elements 1Y, 1M, 1C, and 1K. The frame 45 is also configured to be pulled by springs 33 and 34 in an opposite direction from that in which the frame 45 separates from the photoconductive elements 1Y, 1M, 1C, and 1K until the frame 45 strikes stoppers 35 and 36 provided to the guides 46 and 47 where the frame 45 is retained. The belt 10 is separated from the photoconductive elements 1Y, 1M, 1C, and 1K being pulled by the solenoids 37 and 38 from the opposite side of the springs 33 and 34. When the sensors 20 or 20' are disposed on the frame 45, the relative position of the sensors 20 or 20' to the belt 10 can always be maintained in a fixed relation, and thereby the relative position of the sensors 20 or 20' to the belt 10 does not vary.

Obviously, numerous additional modifications and variations of the present invention are possible in light of the above teachings. It is therefore to be understood that within the scope of the appended claims, the present invention may be practiced otherwise than as specifically described herein.

This document claims priority and contains subject matter related to Japanese Patent Application No. 11-199922, filed on Jul. 14, 2000, and the entire contents thereof are hereby incorporated herein by reference.

What is claimed as new and is desired to be secured by Letters Patent of the United States is:

1. An image forming apparatus, comprising:

a belt configured to convey a sheet-formed medium;

a plurality of recording units arranged in a conveying direction of said sheet-formed medium and respectively including rotating image bearing members configured to perform a process of forming a latent image on each surface of said image bearing members, developing said latent image into a toner image with toner, and transferring said toner image onto said sheet-formed medium carried on the belt;

a detection device configured to detect arbitrary toner images formed at said plurality of recording units and then directly transferred onto said belt; and a contact and separation device configured to enable said belt to contact and separate from each of said image bearing members;

wherein said contact and separation device is configured to be driven so as to separate said belt from each of said image bearing members before said arbitrary toner images transferred onto said belt contact respective following recording units.

2. An image forming apparatus according to claim 1, wherein said detection device is configured to detect a density of said toner images.

3. An image forming apparatus according to claim 1, wherein said detection device is capable of detecting a position of said toner images.

4. An image forming apparatus according to claim 1, wherein said detection device comprises a plurality of photo-sensitive elements.

5. An image forming apparatus according to claim 1, wherein said contact and separation device comprises an arm supporting at least portions of said plurality of recording units and said belt.

6. An image forming apparatus according to claim 5, wherein said contact and separation device further comprises a solenoid configured to position said arm to enable said belt to contact and separate from said image bearing members.

7. An image forming apparatus according to claim 1, wherein said contact and separation device comprises a frame supporting at least portions of said plurality of recording units and said belt.

8. An image forming apparatus according to claim 7, wherein said contact and separation device further comprises solenoids configured to position said frame to enable said belt to contact and separate from said image bearing members.

9. An image forming apparatus according to claim 1, wherein said detection device is configured to move based on whether said belt is in contact with or separated from said image bearing members.

10. An image forming apparatus according to claim 6, wherein said detection device is configured to move based on whether said belt is in contact with or separated from said image bearing members.

11. An image forming apparatus according to claim 8, wherein said detection device is configured to move based on whether said belt is in contact with or separated from said image bearing members.

12. An image forming apparatus, comprising:

means for conveying a sheet-formed medium;

a plurality of means for forming a latent image, developing said latent image into a toner image with toner, and transferring said toner image onto said sheet-formed medium carried on the means for conveying, said plurality of image forming means being arranged in a conveying direction of said sheet-formed medium;

detection means for detecting arbitrary toner images formed at said plurality of image forming means and then directly transferred onto said means for conveying; and contact and separation enabling means for enabling said means for conveying to contact and separate from each of said plurality of image forming means;

wherein said contact and separation enabling means is configured to be driven so as to separate said means for conveying from each of said plurality of image forming means before said each toner image contacts respective following of said plurality of image forming means.

13. An image forming apparatus according to claim 12, wherein said detection means detects a density of said toner images.

14. An image forming apparatus according to claim 13, wherein said detection means detects positions of said toner images.

15. An image forming apparatus according to claim 12, wherein said detection moves based on whether said means for conveying is in contact with or separated from said plurality of image forming means.

16. An image forming apparatus, comprising:

a belt configured to convey a sheet-formed medium;

a plurality of recording units arranged in a conveying direction of said sheet-formed medium and respectively including rotating image bearing members configured to perform a process of forming a latent image on each surface of said image bearing members, developing said latent image into a toner image with toner, and transferring said toner image onto said sheet-formed medium carried on the belt;

a detection device configured to detect arbitrary toner images formed at said plurality of recording units and then directly transferred onto said belt; and a contact and separation device configured to enable said belt to contact and separate from said image bearing members;

wherein said contact and separation device is configured to be driven so as to separate said belt from said image bearing members before said arbitrary toner images transferred onto said belt contact respective following recording units, and wherein said detection device is configured to move based on whether said belt is in contact with or separated from said image bearing members.

17. An image forming apparatus according to claim 16, wherein said detection device is configured to detect a density of said toner images.

18. An image forming apparatus according to claim 16, wherein said detection device is capable of detecting a position of said toner images.

19. An image forming apparatus according to claim 16, wherein said detection device comprises a plurality of photo-sensitive elements.

20. An image forming apparatus according to claim 16, wherein said contact and separation device comprises an arm supporting at least portions of said plurality of recording units and said belt.

21. An image forming apparatus according to claim 20, wherein said contact and separation device further comprises a solenoid configured to position said arm to enable said belt to contact and separate from said image bearing members.

22. An image forming apparatus according to claim 16, wherein said contact and separation device comprises a frame supporting at least portions of said plurality of recording units and said belt.

23. An image forming apparatus according to claim 22, wherein said contact and separation device further comprises solenoids configured to position said frame to enable said belt to contact and separate from said image bearing members.

24. An image forming apparatus, comprising:

means for conveying a sheet-formed medium;

a plurality of means for forming a latent image, developing said latent image into a toner image with toner, and transferring said toner image onto said sheet-formed medium carried on the means for conveying, said plurality of image forming means being arranged in a conveying direction of said sheet-formed medium;

detection means for detecting arbitrary toner images formed at said plurality of image forming means and then directly transferred onto said means for conveying; and contact and separation enabling means for enabling said means for conveying to contact and separate from said plurality of image forming means;

wherein said contact and separation enabling means is configured to be driven so as to separate said means for conveying from said plurality of image forming means before said each toner image contacts respective following of said plurality of image forming means, and wherein said detection means moves based on whether said means for conveying is in contact with or separated from said plurality of image forming means.

25. An image forming apparatus according to claim 24, wherein said detection means detects a density of said toner images.

26. An image forming apparatus according to claim 25, wherein said detection means detects positions of said toner images.

* * * * *